United States Patent [19]

Tanaka et al.

[11] Patent Number: 4,977,350

[45] Date of Patent: Dec. 11, 1990

[54] COLOR ELECTROLUMINESCENCE DISPLAY PANEL HAVING ALTERNATELY-EXTENDING ELECTRODE GROUPS

[75] Inventors: Koichi Tanaka, Nara; Takuo Yamashita, Tenri; Satoshi Yamaue, Nara; Hiroaki Nakaya, Tenri, all of Japan

[73] Assignee: Sharp Kabushiki Kaisha, Osaka, Japan

[21] Appl. No.: 350,513

[22] Filed: May 11, 1989

[30] Foreign Application Priority Data

May 11, 1988 [JP] Japan ..... 63-115068

[51] Int. Cl.[5] ..... H05B 33/06; H05B 33/26

[52] U.S. Cl. ..... 313/505; 313/506; 313/509; 428/917

[58] Field of Search ..... 313/505, 506, 509; 428/690, 917

[56] References Cited

U.S. PATENT DOCUMENTS 4,743,801 5/1988 Yokoyama et al. ..... 313/506 X 4,855,641 8/1989 Nakamura et al. ..... 313/505

*Primary Examiner*—Kenneth Wieder

*Attorney, Agent, or Firm*—Cohen, Pontani & Lieberman

[57] ABSTRACT

A color electroluminescence display panel includes a substrate, a plurality of first and second electrodes disposed orthogonal to each other on the substrate, a luminescence layer interposed between the first and second electrodes, and insulating layers interposed between the electrodes and the luminescence layer, the luminescence layer having a plurality of luminescence layer groups each including a plurality of layer portions of different color luminescence, the first electrodes having a plurality of electrode groups corresponding in number to the luminescence layer groups, each first electrode group including a plurality of electrodes corresponding to the plural layer portions, the electrode groups alternately extending to opposite end portions of the substrate, and the extending end portions of the first electrode and the second electrode being supplied with a luminescence signal therebetween.

6 Claims, 3 Drawing Sheets

FIG.3
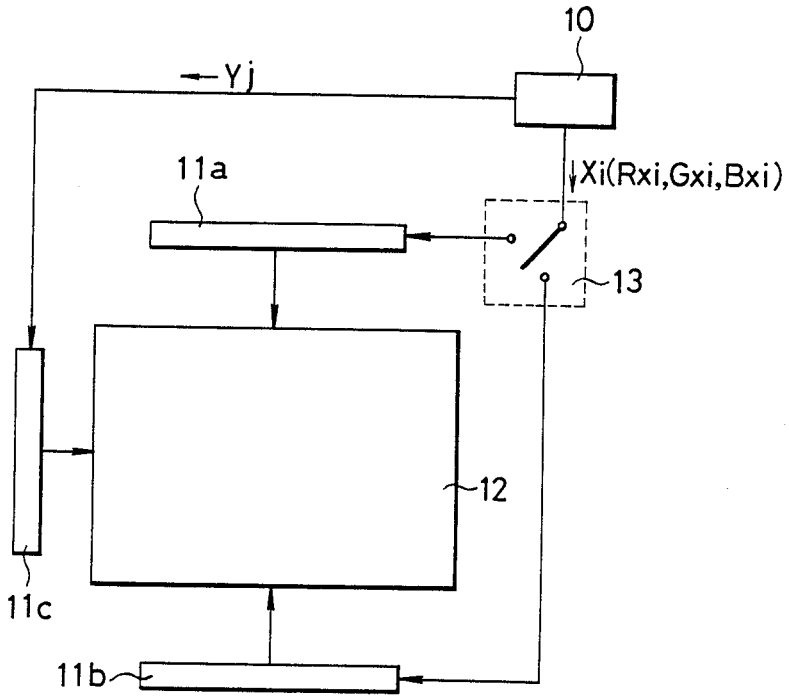
FIG.4(a)
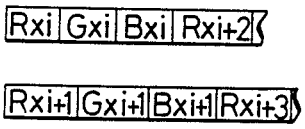
FIG.4(b)
FIG.6(a)
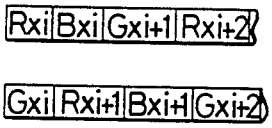
FIG.6(b)

COLOR ELECTROLUMINESCENCE DISPLAY PANEL HAVING ALTERNATELY-EXTENDING ELECTRODE GROUPS

BACKGROUND OF THE INVENTION

1. Field of the Invention

The present invention relates to a matrix type color electroluminescence (EL) display panel for a color display.

2. Description of the Prior Art

Since the discovery of electroluminescence (EL), obtained by applying an electrical field to zinc sulfide (ZnS), luminescent host material, a luminescent center to be added thereto and the like have been researched. As a result, a thin film EL device has been developed which includes a ZnS thin film to which manganese (Mn) is added as a luminescent center, dielectric (insulating) layers being provided on the top and bottom sides thereof and electrodes being further provided on the top and bottom sides thereof where the electrodes on at least one side are transparent. Such thin film EL device is characterized by its high brightness and long life and has therefore been incorporated as a thin and light display element into a display of a portable computer, a measuring device or the like.

A conventional EL display panel has a lamination structure comprising a glass substrate, transparent electrodes and a first insulating layer thereon, a luminescence layer, a second insulating layer and back electrodes. In such a display panel, the transparent electrodes and the back electrodes are formed in a plurality of columns and rows, respectively, that is, arranged as an X-Y matrix. Accordingly, applying voltage to an arbitrary pair of X and Y electrodes causes a point of coordinates (X, Y) to emit light. In this case, a method disclosed in Japanese Patent Publication No. 21795/1983 is generally available for the connection between the electrodes and an external drive circuit; that is, the electrodes are extended alternately to opposite ends of the substrate to broaden the distance between adjacent end portions of the electrodes.

FIG. 5 is a top plan view showing a prior art color EL display panel in which a plurality of row electrodes Yj and a plurality of column electrodes Rxi, Bxi, Gxi orthogonal thereto are formed on a substrate S. Voltage is applied to the respective electrodes Yj and Rxi, Bxi, Gxi so that the coordinates of intersecting points between them are caused to emit light. Three of the electrodes Rxi, Gxi, Bxi, which correspond to the luminescence layers R, G, B for the primary three colors, red, green and blue, make up an electrode for one pixel.

Generally, the color signals for red, green and blue are controlled on the basis of one pixel with regard to luminescent color and brightness with respective luminous intensities, and therefore all of the signals are collectively processed as one unit of information. However, when the luminescence layers for the three primary colors are formed in parallel as shown in FIG. 5, Rxi and Gxi (which make up one pixel together) are extended separately to opposite ends of the substrate. This causes complicated signal processing because signals for the same pixel must be processed separately and transmitted to the alternately-arranged input terminals.

SUMMARY OF THE INVENTION

A color electroluminescence display panel according to the present invention comprises a substrate, a plurality of first and second electrodes disposed orthogonal to each other on the substrate, a luminescence layer interposed between the first and second electrodes, and insulating layers interposed between the electrodes and the luminescence layer, the luminescence layer having a plurality of luminescence layer groups each including a plurality of layer portions of different color luminescence, the first electrodes having a plurality of electrode groups corresponding to the luminescence layer groups, each first electrode of the electrode group being arranged correspondingly to each of the layer portions, all of the electrodes of the same group extending to the same end portion of the substrate, the electrode groups extending alternately to opposite end portions of the substrate, and the extending end portions of the first electrode and the second electrode being supplied with a luminescence signal therebetween.

BRIEF DESCRIPTION OF THE DRAWINGS

FIG. 3 is a block diagram showing a drive circuit of the embodiment in FIG. 1;

FIGS. 4(*a*) and 4(*b*) are diagrams illustrating a signal order in which signals are stored to the registers 11*a*, 11*b*, respectively in FIG. 3;

FIGS. 6(*a*) and 6(*b*) are diagrams corresponding to FIG. 4 but for the prior art embodiment.

DESCRIPTION OF THE PREFERRED EMBODIMENT

In accordance with the present invention, a luminescence layer may be made of any color electroluminescence materials known in the art.

Mn added to ZnS as a luminescent center is in adequate for application to a wide range of use because it has a broad luminescent spectrum with a peak wavelength of 585 nm and emits only yellowish orange light. Accordingly, substances having different color luminescence from that of Mn, especially having the three primary colors red, blue and green, has been desired for application in a wide use. In recent years, various substances have been developed and also their luminous brightness has been impoved in the respective colors of luminescence. The luminescence layer according to the present invention may be made of materials exemplified in Table I. The brightness shown in Table I corresponds to a measuring frequency of 1 KHz. Although those materials emit red or blue luminescence with lower brightness as compared with ZnS: Mn as employed in a commercially available EL display panel, such materials are used in a color EL display panel according to the present invention in expectation of improvements in brightness in the future.

TABLE I

| Color of luminescence | Materials of luminescence layer | Brightness ($cd/m^2$) |
|---|---|---|
| yellowish orange | ZnS:Mn | 2000 |
| red | ZnS:$SmF_3$ | 170 |
| | CaS:Eu | |
| green | ZnS:Tb, F | 1500 |
| blue | SrS:Ce | 50 |

Figure 1:
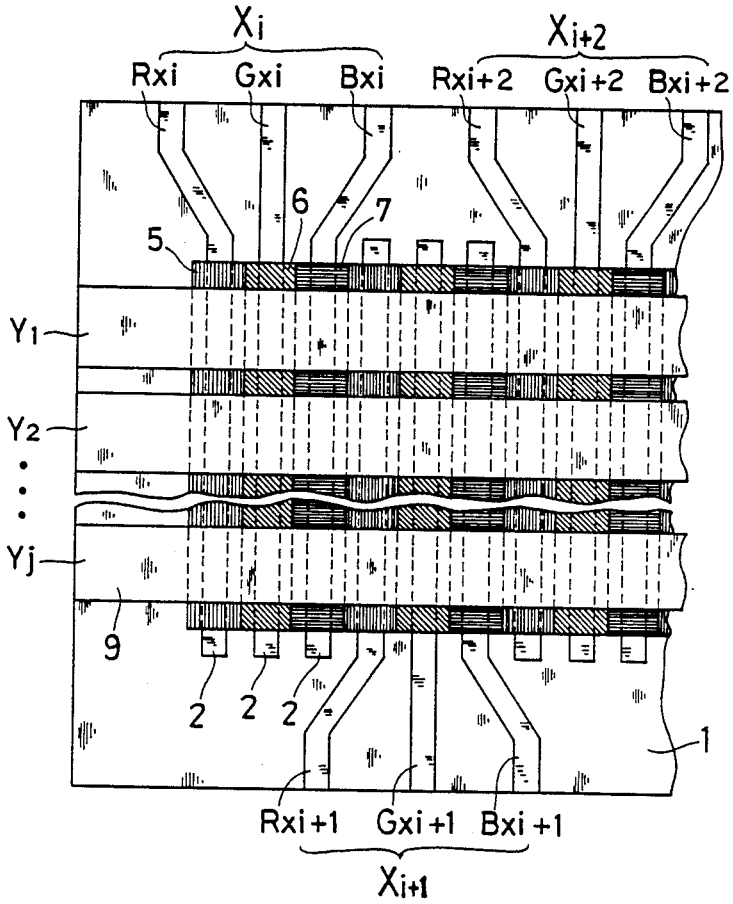
FIG. 1 is an enlarged partial top plan view showing an embodiment according to the present invention.
Figure 2:
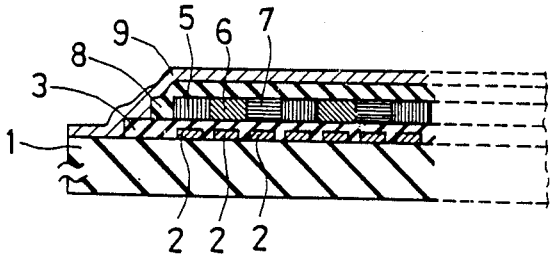
FIG. 2 is a sectional view of FIG. 1.

FIG. 1 is an enlarged partial top plan view showing an embodiment according to the present invention, and FIG. 2 is a sectional view thereof. Referring to these figures, a plurality of transparent column electrodes (X electrodes) 2 made of ITO, $SnO_2$ or the like are formed as strips on a glass or transparent film substrate 1 by means of etching, and every three of those electrodes are grouped as Xi (Rxi, Gxi, Bxi), Xi+1 (Rxi+1, Gxi+1, Bxi+1), and so forth. Deposited on the substrate having the electrodes is a first insulating layer 3 of a single-layer film or composite film made of metal oxide such as $Y_2O_3$, $Ta_2O_5$, $TiO_2$, $Al_2O_3$ or $SiO_2$, or of nitride such as $Si_3N_4$, AlN by means of a thin film deposition technique such as sputtering or electron beam evaporation. Deposited on the first insulating layer 3 in turn are a plurality of columns of CaS : Eu films 5 as a red luminescence layer, ZnS : Tb, F films 6 as a green luminescence layer and SrS : Ce films 7 as a blue luminescence layer by means of a thin film deposition technique such as electron beam evaporation, sputtering or CVD in combination with photolithography. A second insulating layer 8 is deposited on the luminescence layers 5, 6, 7 by using the same materials as that of the first insulating layer 3. Further, a plurality of rows of back electrodes (Y electrodes) 9 of Al are formed over the second insulating layer 8 by etching orthogonal to the transparent electrodes 2. Those electrodes are herein referred to as electrodes Yj(j=1, 2, 3 . . . ). Unlike the conventional color EL display panel, the color El display panel according to the present invention is characterized in that the electrodes Rxi, Gxi, Bxi which make up a column of pixels are grouped together as a trio and that a plurality of the trios are alternately extended to the opposite ends of the substrate so that voltage is applied to the electrodes for light emission, whereby all signal information for any, one pixel can be dealt with collectively. End portions of the electrodes exposed at the ends of the substrate are subjected to evaporation with A−Ni and thereafter soldered to external signal input lines.

Figure 5:
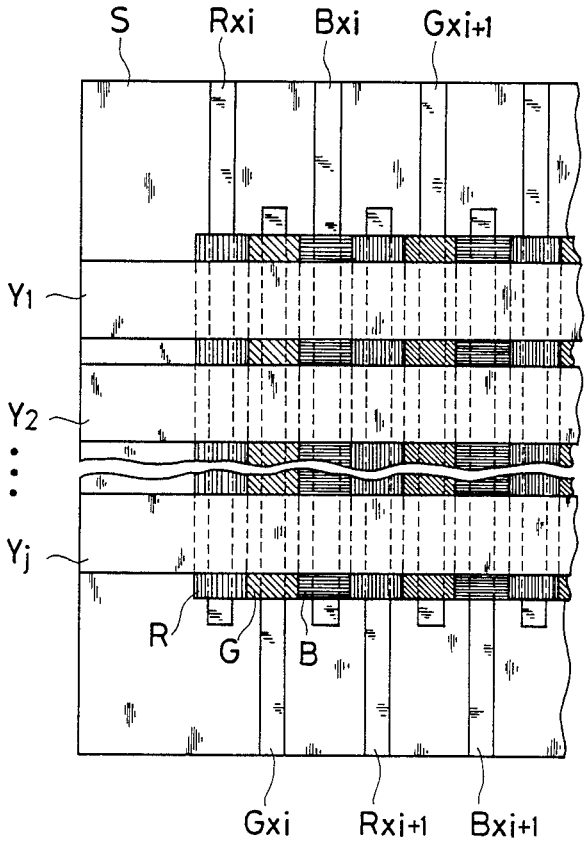
FIG.5 (PRIOR ART)
FIG. 5 is a enlarged partial top plan view showing an prior art embodiment.

FIG. 3 is a block diagram showing a drive circuit for supplying signals to the exemplary color EL display panel shown in FIG. 1. The drive circuit includes a pixel signal output circuit 10, registers 11*a*, 11*b*, 11*c*, the color EL display panel 12 shown in FIG. 1 and a signal switch 13. The pixel signal output circuit 10 supplies a signal Yj corresponding to the electrode Yj to the register 11*c* and also supplies a signal Xi (Rxi, Gxi, Bxi) corresponding to the electrode Xi (Rxi, Gxi, Bxi) to the switch 13 so that the signals Rxi, Gxi, Bxi are collectively inputted to either the register 11*a* or the register 11*b* in every pixel signal by switching of the switch 13. As a result, signals applied to the registers 11*a*, 11*b* are stored in the order shown in FIGS. 4(*a*) and (*b*), respectively. For example, the register 11*a* outputs signals Rxi, Gxi, Bxi to permit a pixel of the electrode Xi to emit light. On the other hand, when the conventional panel having the structure shown in FIG. 5 is employed instead of the inventive color EL display panel 12, the signals applied to the registers 11*a*, 11*b* are stored in the order shown in FIGS. 6(*a*) and 6(*b*), respectively. As can be seen in FIGS. 6(*a*) and 6(*h*) signals corresponding to one pixel are applied separately to the respective registers, so that signal processing should be complicated. Furthermore, the embodiment according to the present invention is applicable where two kinds of luminescence layers (for red and green) or four kinds of luminescence layers (for red, yellow, green and blue) are employed, although three kinds of luminescence layers (for red, green and blue) are employed in the embodiment described herein. The horizontal electrodes Yj may be extended to only one end of the substrate as shown in FIG. 1, or may be alternately extended to opposite ends of the substrate.

As has been described, in accordance with the present invention a color EL display panel which is simple in structure and easy in signal processing of its drive circuit is provided.

What is claimed is:

1. A color electroluminescence display panel, comprising:

a substrate;

a plurality of first and second electrodes on said substrate;

a luminescence layer interposed between said first and second electrodes; and an insulating layer interposed between each of said first and second electrodes and said luminescence layer; said first and second electrodes extending substantially orthogonal to each other and being maintained in noncontact relation with each other by said interposed luminescence and insulating layers;

said luminescence layer comprising a plurality of luminescence layer groups, each including a plurality of layer portions of different color luminescence; and said first electrodes comprising a plurality of electrode groups corresponding to said luminescence layer groups, each including a plurality of electrodes corresponding to said luminescence layer portions of a respective luminescence layer group, all of the plural electrodes of each electrode group extending to the same end portion of said substrate and said electrode groups extending alternately to opposite end portions of said substrate, said first and second electrodes being supplied with a luminescence signal therebetween.

2. A panel according to claim 1 wherein each of said luminescence layer groups emits light in a plurality of colors.

3. A panel according to claim 1 wherein each of said luminescence layer groups has three layer portions for emitting red, green and blue light, respectively.

4. A panel according to claim 1 wherein each electrode group of said first electrodes and each of said second electrodes cross in noncontact relation to define one pixel.

5. A panel according to claim 1 wherein all of said second electrodes extend to an end portion of said substrate.

6. A panel according to claim 1 wherein said second electrodes extend alternately to opposite end portions of said substrate.

* * * * *